United States Patent [19]

Jones, Jr. et al.

[11] 4,043,272

[45] Aug. 23, 1977

[54] RAILWAY LOCOMOTIVE TRUCKS

[75] Inventors: William Clifford Jones, Jr.; Robert E. Long, both of Granite City, Ill.

[73] Assignee: General Steel Industries, Inc., St. Louis, Mo.

[21] Appl. No.: 622,777

[22] Filed: Oct. 15, 1975

[51] Int. Cl.[2] ..... B61C 3/00; B61F 3/06; B61F 5/06; B61F 5/16

[52] U.S. Cl. ..... 105/136; 105/196; 105/199 R

[58] Field of Search ..... 105/34 R, 133, 136, 105/137, 138, 139, 196, 199 R

[56] References Cited

U.S. PATENT DOCUMENTS

| | | | |
|---|---|---|---|
| 2,705,924 | 4/1955 | Travilla et al. | 105/196 X |
| 2,741,996 | 4/1956 | Kolesa | 105/196 |
| 2,821,149 | 1/1958 | Travilla | 105/196 |
| 3,014,435 | 12/1961 | Travilla et al. | 105/196 X |
| 3,288,083 | 11/1966 | Jones | 105/34 R |
| 3,693,553 | 9/1972 | Lich | 105/136 |

*Primary Examiner*—Robert J. Spar
*Assistant Examiner*—Howard Beltran
*Attorney, Agent, or Firm*—F. Travers Burgess

[57] ABSTRACT

Railway three-axle, three-motor locomotive trucks are provided with a bolster spring-supported on the truck frame for lateral and vertical movement and having a central opening to accommodate the middle axle motor while minimizing the over-all height of the truck, a plurality of vertically nonyielding body-support bearing elements on the bolster spaced apart transversely and longitudinally of the truck to prevent tipping of the bolster relative to the body, a swivel connection between the body on the bolster, and a draft connection between the bolster and truck frame at a level at least as low as the axles to provide low-level transmission of traction forces between the truck frame and bolster and thereby reduce axle-to-axle load transference and thereby improve adhesion.

11 Claims, 7 Drawing Figures

RAILWAY LOCOMOTIVE TRUCKS

BACKGROUND OF THE INVENTION:

1. Field of the Invention

The invention relates to railway rolling stock and consists particularly in a three-axle, three-motor electric locomotive truck with improved adhesion characteristics.

2. The Prior Art

The prior art discloses trucks having bolster suspensions similar to that of the invention, as exemplified by Thomas J. Kolesa, U.S. Pat. No. 2,741,996, and James C. Travilla, U.S. Pat.No. 2,821,149. Neither of these patented trucks, which are each directed to nonmotorized trucks, provides the desirably low level of longitudinal force transmission from the truck frame to the bolster whereby axle-to-axle load transference is minimized in the present invention, nor does either patent disclose a bolster contruction capable of accommodating a large middle axle motor while supporting the locomotive body underframe at a relatively low level. Locomotive trucks have been built with low level longitudinal force transmitting devices between the truck frames and bolsters, but none has provided longitudinally widely spaced bolster mounted body support bearings which cooperate with the low level of truck frame-to-bolster longitudinal force transmission to minimize axle-to-axle load transference.

SUMMARY OF THE INVENTION

The invention provides a three-axle electric motor truck having motors on each axle with a soft body suspension and means for accommodating a large middle axle motor without elevating the supported locomotive body and for minimizing axle-to-axle load transference.

An object of the invention is to provide a three-axle three-motor locomotive truck with a spring-supported bolster in which over-all height of the truck is maintained at substantially the same level as trucks with rigid bolsters.

Another object is to provide a three-axle locomotive truck having a spring-supported bolster with means for minimizing axle-to-axle load transference.

A further object is to locate the body-support bearings with reference to the bolster support springs such that the bolster members may be relatively shallow to reduce the over-all height of the truck and provide additional vertical clearance for the traction motors.

A further object is to depress all truck frame parts underlying bolster parts to the lowest practical level whereby to cooperate with a shallow bolster construction to minimize the over-all height of the truck.

DETAILED DESCRIPTION OF THE INVENTION

Figure 1:
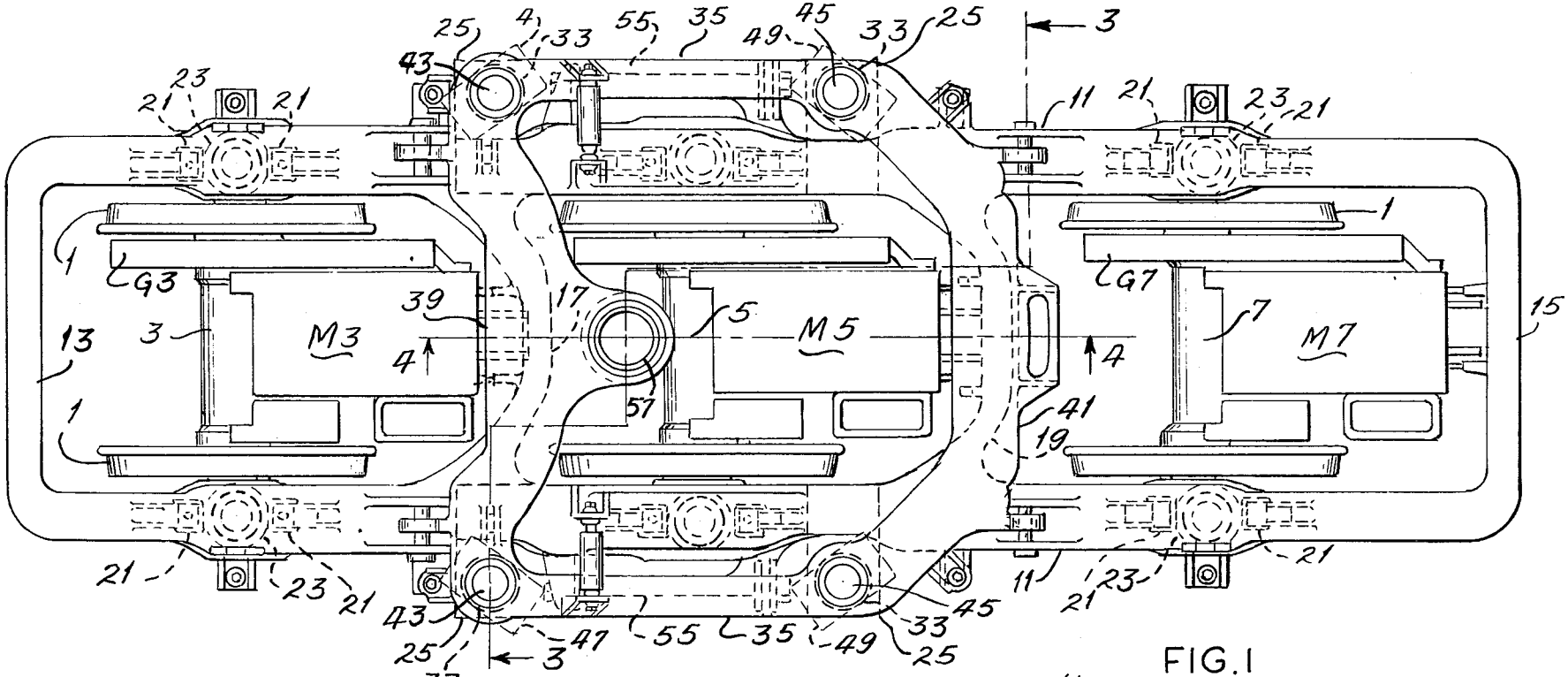
FIG. 1 is a plan view of a truck embodying the invention.
Figure 2:
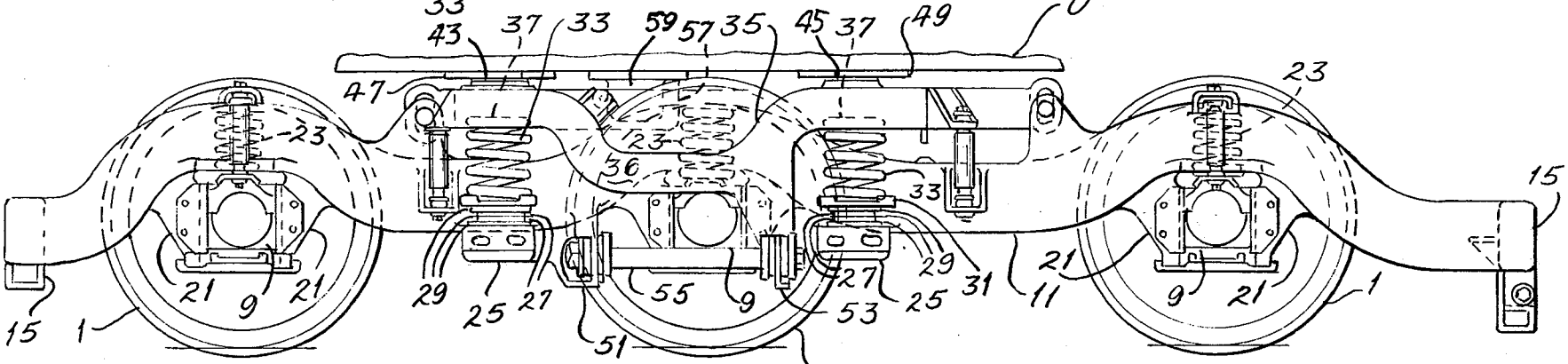
FIG. 2 is a side elevational view of the truck illustrated in FIG. 1.
Figure 3:
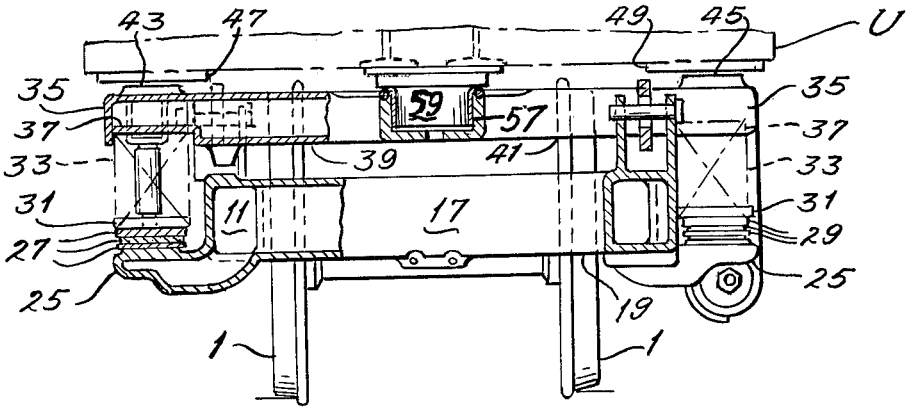
FIG. 3 is a transverse vertical sectional view taken along line 3—3 of FIG. 1.
Figure 4:
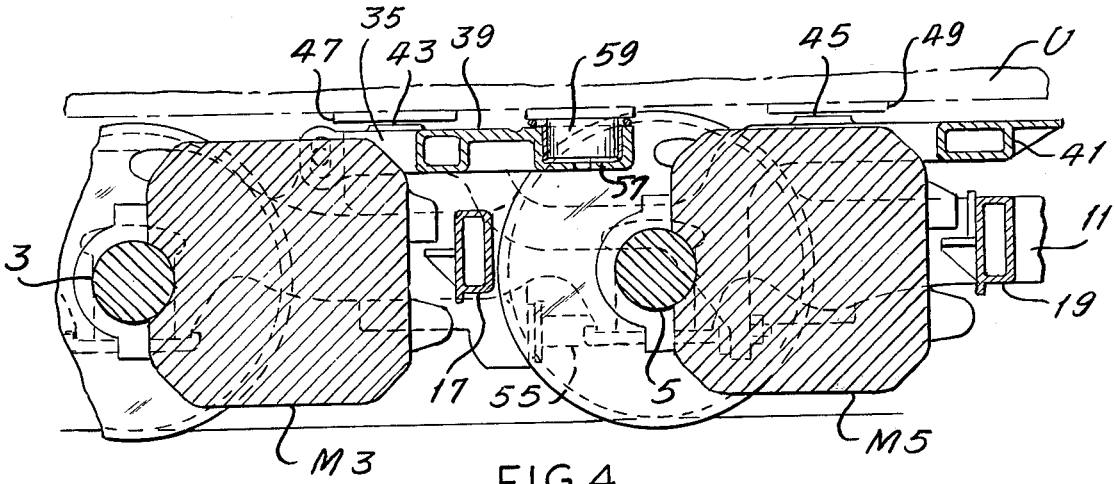
FIG. 4 is a fragmentary longitudinal vertical sectional view taken along the longitudinal center line 4—4 of FIG. 1.

The truck comprises gauged pairs of flanged railway wheels 1 mounted respectively on spaced axles 3, 5 and 7, the ends of which are rotatably received in journal boxes 9. A rigid truck frame comprising a pair of transversely spaced longitudinally extending side members 11 connected at their ends by end transoms 13 and 15 and intermediate their ends by spaced intermediate transoms 17 and 19 has three pairs of spaced pedestal legs 21 depending from each side member 11 and each forming a pedestal jaw vertically slidably receiving a journal box 9. Upright coil springs 23 seated on journal boxes 9 extend upwardly into the hollow interiors of frame side members 11 above the respective pedestal jaws and resiliently support the truck frame on the axles to cushion the truck frame from vertical shocks caused by track irregularities.

Traction motors M3, M5 and M7 are respectively journaled on axles 3, 5 and 7 with their noses extending in the same direction from the respective axles and resiliently supported in the usual manner respectively from intermediate transoms 17 and 19 the center portions of which are offset longitudinally of the truck away from the axles 3 and 5 to accommodate the motor noses, and from end transom 15, to provide motor reaction connections to the respective transoms such that all motors apply vertical forces in the same direction to the frame, tending to maintain it parallel to the track and thus avoid varying the load from axle to axle. Gear boxes G3, G5 and G7 drivingly connect the respective motors to the corresponding axles.

For vertically yieldably supporting the body underframe U from the truck frame and accommodating swivel and relative lateral movement between the truck frame and underframe U, each truck frame side member is formed with a pair of outboard shelf-like brackets 25 between the middle axle and the end axles, and an elastomeric pad device comprising a plurality of flat horizontal pads 27 of elastomeric material bounded and interleaved by metal plates 29 is seated on each bracket 25 and mounts an upwardly open spring seat 31, in which is seated an upright coil spring 33.

A body-support bolster has longitudinally extending side members 35 positioned outwardly of frame side members 11 and each formed with a pair of downwardly open spring caps 37 seated on springs 33. At their ends side members 35 are connected to each other by longitudinally spaced transverse end members 39 and 41, which extend on frame side members 11 between the axle locations, side members 11 being depressed to a low level between middle and end axle pedestals 21, 21.

The central portion of end member 39 is offset longitudinally inwardly toward central axle 5 to clear motor M3 and the central portion of end member 41 is correspondingly offset longitudinally toward end axle 7 to clear motor M5, the space above the latter being unobstructed by reason of the opening in the bolster defined by bolster side members 35 and end members 39 and 41.

For stably supporting the body underframe U on the bolster, the latter is provided with four transversely and longitudinally spaced upwardly facing, substantially vertically nonyielding, bearing surfaces 43, 43 preferably directly above coil springs 33 at the intersection of bolster end member 39 and side members 35, and 45, 45 preferably directly above coil springs 33 at the intersection of bolster end member 41 and side members 35. The underframe U is provided with four correspondingly postioned downwardly facing vertically substantially nonyielding bearing pads 47, 47 and 49, 49, all elongated on axes tangent to an arc concentric with the swivel axis of the truck for horizontal sliding engagement with upwardly facing bearings 43 and 45 respectively. The location of bearings 43 and 45 directly above springs 33 provides a direct vertical load path through the bolster to the springs, permitting the usage of relatively shallow and light bolster side and end members.

For transmitting traction forces from the truck frame to the bolster at the level nearest the rail as possible and thereby minimize the vertical moment arm about which traction forces would act to tip the truck frame, each side member 11 is formed near a middle axle pedestal leg with an outboard bracket 51 at the lowest level consistent with clearance limitations, preferably substantially below the axle centers, and spaced longitudinally of the truck therefrom, the depressed center portion 36 of each bolster side member 35 is formed with a depending bracket 53 at the same level, and at each side of the truck, a longitudinally extending anchor link 55 is pivotally connected to brackets 51 and 53.

For transmitting longitudinal forces from the truck to underframe U and defining a swivel axis for the truck, the offset center portion of bolster end member 39 is formed with a center projection toward the middle axle, i.e., in the direction of the center of the quadrilateral defined by bearings 43 and 45 and is formed with an upwardly open vertical cylindrical recess, in which is pivotally received a mating cylindrical boss or spigot 59 depending from underframe U, the bottom of spigot 59 being vertically spaced from the bottom of recess 57 so that these elements function solely as a pivot and horizontal force transmitting member and do not transmit any vertical load from the body underframe U to the truck.

All vertical loads are transmitted at the four points defined by bearings 43 and 45 and because of the spacing of these longitudinally and transversely of the truck, the bolster is constantly held against tipping with respect to underframe U, and because of this, the effective point at which traction forces are transmitted from the truck frame to the body underframe is at the level of anchor link 55, thus minimizing the length of moment arm about which the traction forces would act to tip the truck frame and transfer the load from axle to axle.

Figure 7:
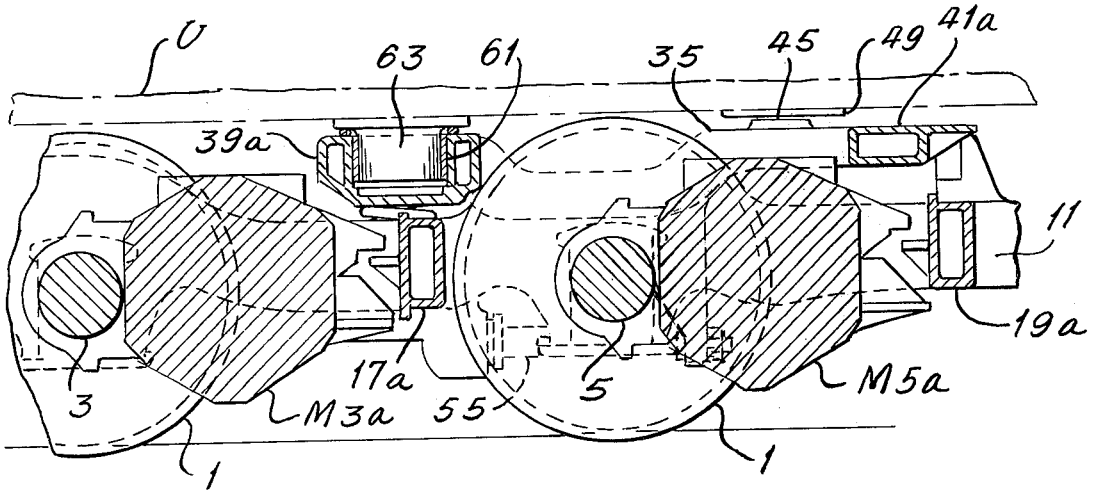
FIG. 7 is a longitudinal vertical sectional view taken along the longitudinal center line 7—7 of FIG. 5.
Figure 6:
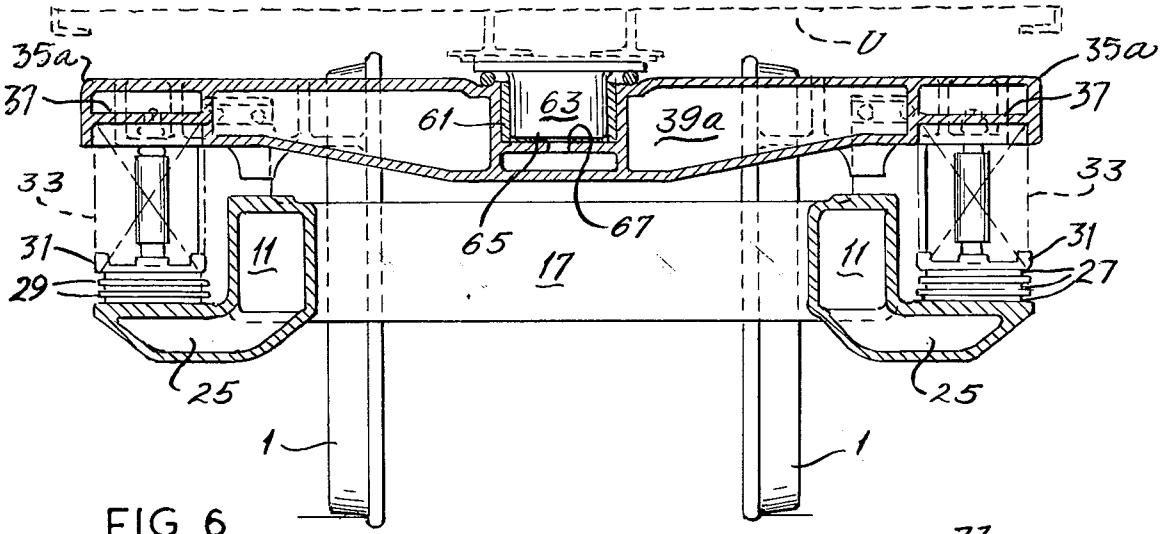
FIG. 6 is a transverse vertical sectional view along line 6—6 of FIG. 5.
Figure 5:
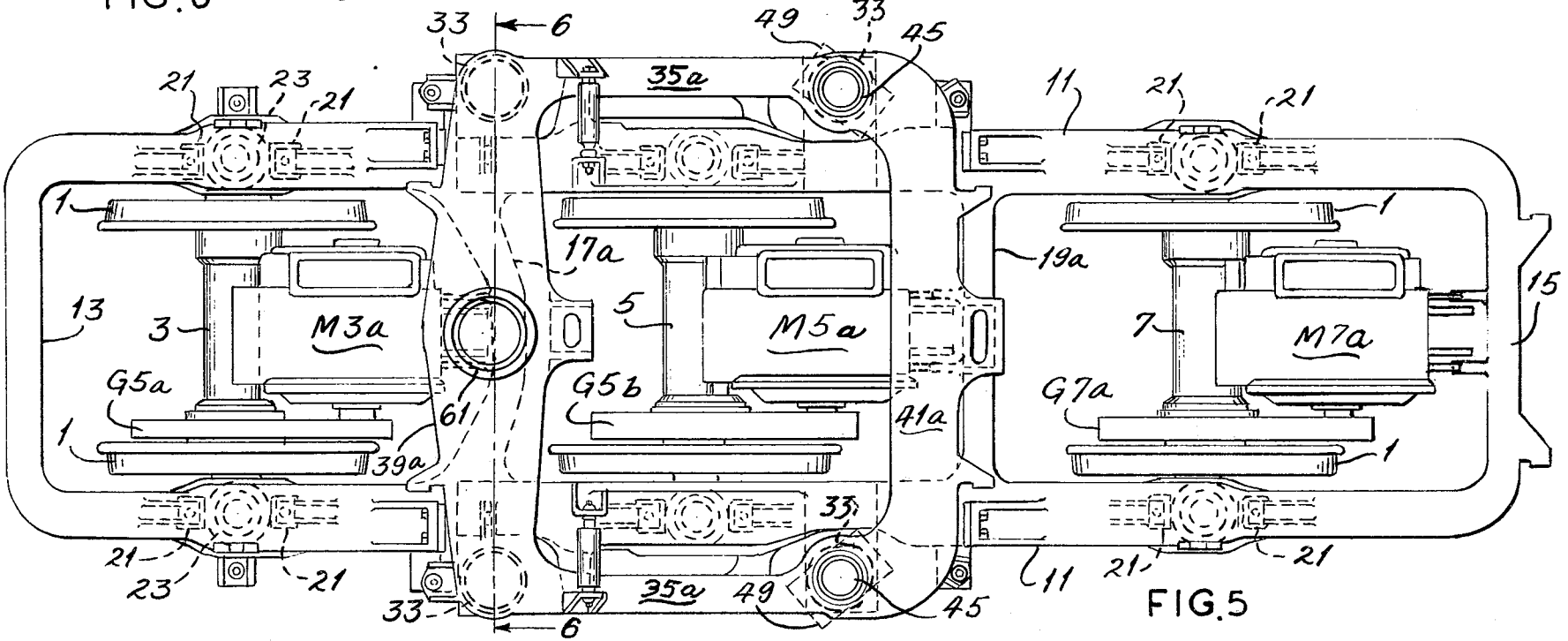
FIG. 5 is a plan view of a truck embodying a modified form of the invention.

In the embodiment shown in FIGS. 5–7, the truck parts (unless otherwise specified) are substantially the same as in FIGS. 1–4 and corresponding reference numerals are applied to unchanged parts, but consistent with the application of different motors M3*a,* M5*a* and M7*a* the shapes of intermediate transoms 17*a* and 19*a* are different as are bolster end members 39*a* and 41*a* which are straight transversely of the truck and not offset longitudinally in the manner of end members 39 and 41 of the embodiment of FIGS. 1–4.

This construction permits a simplified arrangement of the body support bearings, with bearings 43 eliminated and replaced by loaded center plate comprising an upwardly open vertical cylindrical recess 61 at the center of bolster end member 39*a* substantially in transverse alignment with springs 33, and underframe U has a depending cylindrical boss or spigot 63 matingly received in recess 61 with its bottom surface 65 in load bearing engagement with the bottom surface 67 of recess 61.

Thus in this embodiment, the body load is supported at three instead of four points on the bolster, one of the points, center plate 61, 63 serving both as a load support and swivel connection. Because of the spacing of the center plate and bearing 45 longitudinally of the truck, the bolster cannot tip with respect to the underframe, and this, combined with the low level location of anchor link 55 minimizes axle-to-axle load transference.

It will be understood that the invention is applicable to other than three-axle trucks, e.g., to a two-axle truck having a single motor between the axles.

The trucks may be modified in various respects as may occur to those skilled in the art without departing from the spirit of the invention and the exclusive use of all such modifications as come within the scope of the appended claims is contemplated.

We claim:

1. In a railway truck, three wheeled axles including a first end axle, a middle axle and a second end axle, a truck frame resiliently supported on said axles and having longitudinally extending side members outboard of said wheels with portions elevated over said axles and depressed portions therebetween, first and second transverse transom members connecting said frame side member depressed portions intermediate said middle axle and the respective end axles, individual traction motors drivingly connected to said axles and having a reaction connection to said truck frame, a pair of outboard upright springs carried on each side member of said truck frame and spaced apart longitudinally thereof, the corresponding springs of each pair being aligned with each other transversely of the truck, a body-support bolster comprising transversely spaced apart longitudinally extending side members transversely outboard of said frame side members and longitudinally spaced apart end members extending over said depressed portions of said frame side members and the respective transom members defining a substantially unobstructed opening receiving the upper portion of said middle axle motor, said bolster being supported on said springs in the regions of the intersections of said bolster end and side members and having at least three vertically substantially rigid upwardly facing bearings spaced apart longitudinally and transversely of the truck for vertically substantially rigidly supporting a body on said bolster, all of said upwardly facing bearings being in alignment transversely of the truck with said transversely aligned springs, at least two of said upwardly facing bearings being in the region of the intersections between one of said bolster end members and said bolster side members, means forming a longitudinal force transmitting connection between said bolster and said frame at a level below said axle centers, and a vertical axis swivel bearing on the other bolster end member.

2. In a railway truck according to claim 1, said rigid bearings including a pair at each side of said bolster, the bearings of each pair being longitudinally spaced from each other and transversely aligned with and spaced from the corresponding bearing of the other pair, all of said bearings overlying the corresponding bolster supporting springs.

3. In a railway truck according to claim 2, said other bolster end member having a central projection extending longitudinally inwardly part way toward said one end member, said vertical axis swivel bearing being located in the end portion of said projection and being free of vertical loading.

4. In a railway truck according to claim 1, said vertical axis swivel bearing surrounding the third one of said upwardly facing bearings at the center of said other bolster end member and forming a vertically loaded swivel center plate aligned transversely of the truck with the bolster-support springs located in the region of the intersections of said other bolster end member and said bolster side members.

5. In a railway truck according to claim 1, each of said frame side members being formed with a pair of outboard brackets between said middle and the respective end axles, there being a pair of said springs seated on each of said brackets, said bolster side members resting on said springs.

6. In a railway truck according to claim 1, said first end axle and said middle axle motors having their reaction connections to said first and second intermediate transoms respectively.

7. In a railway truck according to claim 6, a transverse end transom connecting said frame side members longitudinally outwardly of the truck from said second end axle, said second end axle motor having its reaction connection to said end transom.

8. In a railway truck according to claim 6, said first and second intermediate transoms having their respective center portions offset longitudinally of the truck toward the middle and second end axles respectively to accommodate said first end axle and middle axle motors without increasing the truck wheelbase.

9. In a railway vehicle truck according to claim 8, said bolster end members being centrally offset respectively toward the middle axle and the second end axle to clear the first end axle and middle axle motors.

10. In a railway vehicle truck according to claim 1, said spring-overlying upwardly facing bearings being substantially aligned vertically with the corresponding bolster-support springs whereby to provide a direct vertical load path therebetween and permit the bolster side and end members to be of shallow and light contruction.

11. In a railway vehicle truck according to claim 1, said frame side member being formed with outboard brackets between the middle axle and one end axle and said bolster side members being formed with depending brackets between the middle axle and the other end axle, said longitudinal force transmitting connections comprising longitudinally extending anchor links pivotally connected at their opposite ends to said depending brackets and to said outboard brackets.

* * * * *